United States Patent [19]

Geke et al.

[11] Patent Number: 4,784,798

[45] Date of Patent: Nov. 15, 1988

[54] DEMULSIFYING CLEANING PREPARATION HAVING A PROLONGED SURFACE-WETTING EFFECT

[75] Inventors: Juergen Geke; Friedbert Zetzsche, both of Duesseldorf, Fed. Rep. of Germany

[73] Assignee: Henkel Kommanditgesellschaft auf Aktien, Duesseldorf, Fed. Rep. of Germany

[21] Appl. No.: 133,182

[22] Filed: Dec. 14, 1987

Related U.S. Application Data

[63] Continuation of Ser. No. 885,980, Jul. 15, 1986, abandoned.

[30] Foreign Application Priority Data

Aug. 28, 1985 [DE] Fed. Rep. of Germany ..... 3530623

[51] Int. Cl.[4] ..... C11D 7/32

[52] U.S. Cl. ..... 252/544; 252/153; 252/170; 252/174.21; 252/525; 252/527; 252/DIG. 14; 134/34; 134/40

[58] Field of Search ..... 252/110, 111, 117, 118, 252/139, 154, 174.21, 170, 171, 525, 527, DIG. 14, 544, 546, 391; 134/39, 40

[56] References Cited

U.S. PATENT DOCUMENTS

| | | | |
|---|---|---|---|
| 3,715,324 | 2/1973 | Hynes et al. | 252/156 |
| 4,167,488 | 9/1979 | Murtaugh | 252/525 |
| 4,233,174 | 11/1980 | Sheridan | 252/170 |
| 4,372,788 | 2/1983 | Lancz | 252/156 |
| 4,477,365 | 10/1984 | Verboom et al. | 252/158 |
| 4,627,931 | 12/1986 | Malik | 252/174.21 |
| 4,636,359 | 1/1987 | Penninger | 252/391 |

OTHER PUBLICATIONS

Kirk-Othmer, Encyclopedia of Chemical Technology, vol. 15, Third Edition.

*Primary Examiner*—Paul Lieberman
*Assistant Examiner*—Hoa Van Le
*Attorney, Agent, or Firm*—Ernest G. Szoke; Henry E. Millson, Jr.; Real J. Grandmaison

[57] ABSTRACT

This invention relates to demulsifying cleaning preparations having a prolonged surface-wetting effect which contain the following components:

(a) builders/complexing agents in an amount of from 0.5 to 10% by weight,
(b) one or more alkanolamines in an amount of from 20 to 60% by weight,
(c) one or more nonionic surfactants in an amount of from 1 to 15% by weight and
(d) water in an amount which, with components (a), (b) and (c), adds up to 100% by weight.

The cleaning preparations are suitable for cleaning and degreasing lacquered or non-lacquered vehicle surfaces, engines, floors and walls of workshops at temperatures as low as room temperature with demulsification of the oily or fatty soil removed.

13 Claims, No Drawings

DEMULSIFYING CLEANING PREPARATION HAVING A PROLONGED SURFACE-WETTING EFFECT

This application is a continuation of application Ser. No. 885,980 filed July 15, 1986 now abandoned.

BACKGROUND OF THE INVENTION

1. Field of the Invention

This invention relates to new cleaning preparations with which lacquered or non-lacquered surfaces of vehicles, engines, floors in workshops or other work surfaces may be cleaned and degreased, the soil removed being demulsified.

2. Description of Related Art

Preparations for cleaning hard surfaces soiled with fats or fatty substances are commonly used, particularly in the field of engineering. The corresponding cleaning operations have hitherto been carried out either with compositions which emulsify fats or fatty soils, or with so-called "cold cleaners". Cold cleaners (cf. Rompp's Chemie-Lexikon, Franck'sche Verlagsbuchhandlung Stuttgart, Vol. 3 (1983), pp. 2033–34) are solvent mixtures which contain large amounts of chlorinated or non-chlorinated hydrocarbons (petroleum fractions) and which are used with or without emulsifiers and other additives for the cold removal of fats, oils, waxes, tar, etc. In cases where cold cleaners of the aforementioned type are used, the wastewaters are polluted not only with the fats, oils, etc. detached from the treated surfaces, but also with the organic solvents, particularly chlorinated hydrocarbons, so that the environment-polluting components have to be separated from the corresponding wastewaters because of legal requirements. In addition, cold cleaners containing organic solvents have the further disadvantage that inflammable, pungent or even health-hazardous vapors are formed during the cleaning operation, so that the corresponding cleaning operations can only be carried out with extreme safety and health-protection measures.

The first-mentioned cleaning preparations containing emulsifying components have the major disadvantage that, although fats or fatty soil can be removed from the surfaces to be cleaned, these soil types are emulsified in the water. Inevitably, either relatively large amounts of oils, fats or other soil types enter the wastewater, which is undesirable on account of the environmental pollution involved, or additional agents have to be added to the wastewater to break the emulsions formed in order to enable the organic soils to be separated off in oil separators. Aside from economic aspects, however, the subsequent addition of demulsifying agents involves further pollution of the wastewaters so that this is also not a satisfactory solution thereto.

DE-OS No. 25 29 096 describes cold cleaning preparations for hard surfaces soiled with fats or fatty substances which consist essentially of aqueous emulsions of ethoxylated phenols containing from 8 to 20 carbon atoms in the alkyl chain, and ethoxylated aliphatic alcohols containing from 9 to 18 carbon atoms in the alkyl chain. The proposed cleaners are neutral to mildly alkaline and combine good fat-dissolving power with safe handling by virtue of their low alkalinity or neutrality.

In addition, DE-OS No. 29 01 927 proposes cleaning preparations for removing oily soils which contain fatty alcohol ethoxylates in combination with phenol or lower alkyl phenol ethoxylates. In the cleaning operation, the fatty or oily soil types are removed in the form of an emulsion from the surface to be cleaned. Although the emulsions formed are relatively short-lived, it is several hours before they can be broken.

In addition to the above-mentioned disadvantages which attend most state-of-the art cleaning preparations, the aforementioned cleaners have such a consistency that they run immediately after application to vertical surfaces, for example, to walls or to the vertical outer surfaces of motor vehicles, and a prolonged contact time can only be obtained by the addition of a viscosity-increasing agent or by repeated treatment of the surface with the cleaner. Accordingly, the soiled surface is not kept in contact with the cleaner for a sufficiently long period so that repeated application is generally necessary.

SUMMARY OF THE INVENTION

The object of the present invention is to provide an alternative to state-of-the-art preparations in the form of cleaners which may be used without polluting the environment. More particularly, the cleaners according to the invention are intended to avoid emulsification of the fatty soils, and to eliminate completely the need to use organic solvents, for example, chlorinated hydrocarbons, esters and fractions from the distillation of mineral oil, gasoline, or various hydrocarbons. The novel cleaners are intended to be applied in any way and, simultaneously, to provide prolonged wetting of the treated surface. In addition, they are intended to develop a cleaning effect at temperatures as low as room temperature and to be biodegradable beyond the legally stipulated limit (Detergents Act, Chemicals Act).

DETAILED DESCRIPTION OF THE INVENTION

It has now surprisingly been found that cleaning preparations having a good cleaning effect and demulsifying properties, while keeping the surface to be cleaned in contact with the cleaner components for a sufficiently long period, even without viscosity-increasing agents, can be obtained by using aqueous combinations of builders or complexing agents with one or more alkanolamines and one or more nonionic surfactants.

Other than in the operating examples, or where otherwise indicated, all numbers expressing quantities of ingredients or reaction conditions used herein are to be understood as modified in all instances by the term "about".

Accordingly, the present invention relates to demulsifying cleaning preparations having a prolonged surface-wetting effect which contain the following components:

(a) builders/complexing agents in an amount of from 0.5 to 10% by weight, (b) at least one alkanolamine in an amount of from 20 to 60% by weight, (c) at least one nonionic surfactant in an amount of from 1 to 15% by weight, and (d) water in an amount which, with components (a), (b) and (c), adds up to 100% by weight, all weights being based on the weight of the cleaning preparations.

The demulsifying cleaning preparations according to the invention may optionally contain solution promoters in an amount of from 1 to 10% by weight, corrosion inhibitors for lightweight metals in an amount of from 0.15 to 0.25% by weight, corrosion inhibitors for nonferrous metals in an amount of from 0.2 to 0.4% by weight, and perfumes or dyes in an amount of from 0 to 1% by weight.

Suitable builders/complexing agents are compounds which complex alkali metal, alkali-earth metal and/or transition metal ions, such as for example, ethylenediamine tetracetic acid, nitrilotriacetic acid, diethylenetriamine pentacetic acid, N-(2-hydroxyethyl)-ethylenediamine triacetic acid (Trilon ®C) and water-soluble alkali metal salts, preferably sodium salts, thereof. The builders/complexing agents mentioned are preferably used in a quantity of from 2 to 4% by weight in the cleaning preparations according to the invention.

Alkanolamines are a component of the cleaning preparations according to the invention. It is possible to use either one compound of this type or several such compounds mixed in any ratio with one another. Examples of preferred alkanolamines are diethanolamine, triethanolamine, diisopropanolamine and triisopropanolamine. Compounds of this type are preferably used in quantities of from 25 to 50% by weight, based on the weight of the cleaning preparations.

To achieve the effect of "prolonged wetting" of the treated surface desired in accordance with the invention, i.e., prolonged contact of the components of the cleaning preparation with the treated surface after application of the preparation, the use of the alkanolamine component in a quantity of at least 20% by weight is critical. That is, quantities of alkanolamine below 20% by weight, based on the aqueous cleaner concentrate according to the invention, would noticeably impair the desired "prolonged wetting effect".

The demulsifying cleaning preparations according to the invention contain nonionic surfactants as a further component. In this case, too, it is possible to use either a single compound of this type or alternatively a mixture of two or more nonionic surfactants, providing the quantity used is in the range of from 1 to 15% by weight. Suitable compounds of this type are adducts of 4 moles of ethylene oxide with n- or i-octanol and also adducts of 2 moles of propylene oxide and 5 to 6 moles of ethylene oxide with the C8-alcohols mentioned. The nonionic surfactants are preferably used in a quantity of from 3 to 6% by weight, based on the weight of the cleaning preparations.

Suitable solution promoters, which may be additionally incorporated in the demulsifying cleaning preparations consisting of the above-mentioned components (a), (b), (c) and (d), are aromatic sulfonates, such as cumene sulfonate or butyl glycosulfonate. Corrosion inhibitors for lightweight metals, such as phosphoric acid for example, and/or corrosion inhibitors for nonferrous metals, such as tolyl triazole for example, may also be added. If desired, the demulsifying cleaning preparations according to the invention may also contain perfumes and/or dyes.

The cleaning preparations are produced by mixing the components mentioned together in their respective quantities using conventional methods. The cleaning preparations are stored and dispatched generally in the form of an aqueous concentrated containing the combination of components mentioned, on which the quantities indicated in % by weight are also based.

For cleaning and degreasing lacquered or nonlacquered surfaces of vehicles, engines, floors, walls of workshops, etc., the demulsifying cleaning preparations according to the invention with their prolonged wetting effect are used in any dilution with water. Aqueous solutions having a concentration of 3% or higher of the concentrate are used depending upon the method of application and the degree of soiling of the surfaces to be cleaned. With heavy soiling, it is even possible to use the concentrate. The cleaning preparations according to the invention may be applied by spraying, immersion or by high-pressure spraying using appropriate equipment. Outstanding cleaning results are obtained even at room temperature. In addition, the composition of the cleaning preparation assures approximately 20 to 30 minute duration wetting of the surface to be cleaned and hence correspondingly long contact of the cleaning components with the soil. This is particularly important for obtaining a good cleaning result in the cleaning of locomotives, for example.

Apart from the prolonged wetting effect mentioned above, the demulsifying effect is a major advantage over state-of-the art products. If a use-solution according to the invention having a concentration of from 10 to 50% is diluted with rinsing waters to a concentration of, or less than, 2%, for example at room temperature, mineral oil additionally introduced automatically separates from the solution almost completely when the solution is left standing for 30 minutes. Using corresponding wastewater collecting vessels, the oil content of wastewater can be reduced to less than 50 mg/l solely by mechanical oil separation such as this.

It may be possible, for the purpose of further reducing the oil content, to add iron sulfate or aluminum sulfate to the wastewater and, in this way, to obtain flocculation of the impurities. By this additional cleaning step which is known from the prior art, the residual oil content in the wastewater can be reduced to below 10 mg/l.

The invention is further illustrated by the following Examples.

EXAMPLE 1

Cleaning effect

Degreased steel plates (50 mm×100 mm×1 mm) were immersed in a mixture of superheated steam cylinder oil and ASTM III-oil in a ratio by volume of 1:1, removed after 10 minutes and vertically suspended for 4 hours. The test plates thus pretreated were then immersed in 50% cleaner solution having the following composition and the time required to obtain complete degreasing (visual assessment) was measured.

(a) cleaning preparation according to the invention (concentrate):
- 7% by weight nitrilotriacetate trisodium salt (Trilon ®A, 38%),
- 9.5% by weight diethanolamine,
- 18.0% by weight triethanolamine,
- 6.0% by weight of a condensation product of n-octanol with 4 moles ethylene oxide,
- 5.0% by weight sodium cumene sulfonate (40%), and
- 54.5% by weight water.

(b) cleaning preparation according to the invention (concentrate):
- 4.0% by weight ethylenediamine tetracetate, sodium salt (Trilon ®B),
- 30.0% by weight triethanolamine,
- 15.0% by weight diethanolamine,
- 7.0% by weight of a condensation product of i-octanol with 2 moles propylene oxide and 5 to 6 moles ethylene oxide,
- 3.0% by weight sodium butyl glycol sulfonate,
- 0.2% by weight phosphoric acid, 0.2% by weight tolyl triazole, and
40.6% by weight water.

Comparison cleaning preparation (concentrate):
5% by weight of a condensation product of nonylphenol with 5 moles ethylene oxide,
2% by weight sodium cumene sulfonate,
5% by weight ethylene glycol monobutylether,
1% by weight sodium hydroxide, and
87% by weight water.

Accordingly, the comparison cleaning preparation contained a surfactant having a strong emulsifying effect.

The cleaning effect of the preparations according to the invention was distinctly better than that of the comparison cleaning preparation. A time factor of 0.7 in favor of the cleaning preparations acording to the invention was obtained, i.e., the cleaning preparations according to the invention produced the complete degreasing required in a much shorter time compared with the comparison cleaner.

EXAMPLE 2

Prolonged wetting:

Prolonged wetting for a certain period is essential to obtain an optimal cleaning result, above all, in the external cleaning of vehicles. Cleaners (a) and (b) mentioned in Example 1 were diluted with water in a ratio by volume of 1:10. A steel plate (50 mm×100 mm×1 mm) coated with polyurethane lacquer was immersed in the corresponding cleaning solutions, removed after a few minutes and vertically suspended. After 25 minutes, a film of liquid which could be wiped with the finger was still present on the treated lacquer surfaces.

EXAMPLE 3

Demulsification:

The following components were mixed in a 2-liter glass beaker and stirred for 10 minutes at half the depth of the liquid (16/15 mm propeller stirrer, speed 800 revolutions/minute).

1620 ml water,
20 ml cleaner concentrate of Example 1(a) and (b),
2 ml of a mixture of superheated steam cylinder oil and ASTM III-oil in a ratio by volume of 1:1.

After 10 minutes, the mixture was transferred to a 2-liter separation funnel and left standing for 30 minutes. After 30 minutes, a 500 ml liquid sample was run off from the separation funnel. This water sample contained only small amounts of residual oil, i.e., less than 50 mg/l.

0.75 g anhydrous aluminum sulfate was added to another 500 ml sample of the solution drained off from the separation funnel and the pH-value was adjusted to 7.3 with 1N sodium hydroxide. The solution was then left standing for 30 minutes. The flocculent deposit formed was filtered off by means of a filter (NN 651 ¼). The residual oil content of the filtrate was less than 10 mg/l.

EXAMPLE 4

Corrosion inhibition:

In addition to prolonged surface wetting, the film of product remaining on the cleaned parts after treatment therewith also provides for essential temporary corrosion inhibition. This is particularly important in the cleaning of engine compartments.

Testing of the product for corrosion inhibition in storage was carried out by the so-called "plate conditioning test". ST 1405 steel plates were cleaned with trichloroethylene and then immersed in 10% solutions of the cleaners according to the invention. After 5 minutes, the plates were removed and dried at room temperature. The plates were stored in a conditioning box at 23° C./100% relative air humidity. Plates treated in this way showed no signs of corrosion, even after 14 days.

The addition of 0.15 to 0.25% by weight phosphoric acid to the product concentrate and/or 0.2 to 0.4% by weight tolyl triazole to the product concentrate afforded lightweight metal surfaces, such as aluminum or magnesium surfaces, for example, and nonferrous metal surfaces complete protection against corrosion.

We claim:

1. A demulsifying cleaning preparation free of organic solvent and having a prolonged surface-wetting effect consisting essentially of;

(a) a builder/complexing agent in an amount of from about 0.5 to about 10% by weight,
(b) at least one alkanolamine in an amount of from about 20 to about 60% by weight,
(c) at least one nonionic surfactant in a quantity of from 1 to 15% by weight, said nonionic surfactant being selected from the group consisting of the condensation products of n-octanol with 4 moles of ethylene oxide, i-octanol with 4 moles of ethylene oxide, n-octanol with 2 moles of propylene oxide and 5 to 6 moles of ethylene oxide and i-octanol with 2 moles of propylene oxide and 5 to 6 moles of ethylene oxide, and
(d) water in an amount which, with components (a), (b) and (c), adds up to 100% by weight, all weights being based on the weight of said cleaning preparation, and as optional constituents;
(e) a solution promoter in an amount of from about 1 to about 10% by weight,
(f) a corrosion inhibitor for lightweight metals in an amount from about 0.15 to about 0.25% by weight said corrosion inhibitor comprising phosphoric acid,
(g) a corrosion inhibitor for nonferrous metals in an amount of from about 0.2 to about 0.4% by weight said corrosion inhibitor coprising tolyl triazole, and
(h) a perfume or dye in an amount of from about 0 to about 1% by weight.

2. A demulsifying cleaning preparation in accordance with claim 1 wherein said builder/complexing agent is present in an amount from about 2 to about 4% by weight.

3. A demulsifying cleaning preparation in accordance with claim 1 wherein said alkanolamine is present in an amount of from about 25 to about 50% by weight.

4. A demulsifying cleaning preparation in accordance with claim 1 wherein said nonionic surfactant is present in an amount of from about 3 to about 6% by weight.

5. A demulsifying cleaning preparation in accordance with claim 1 wherein said builder/complexing agent is selected from the group consisting of ethylenediamine tetracetic acid, nitrilotriacetic acid, diethylenetriamine pentacetic acid, N-(2-hydroxyethyl)-ethylene diamine triacetic acid, and water soluble alkali metal salts thereof.

6. A demulsifying cleaning preparation in accordance with claim 5 wherein said builder/complexing agent is selected from the group consisting of the sodium salts of ethylenediamine tetracetic acid and nitrilotriacetic acid.

7. A demulsifying cleaning preparation in accordance with claim 1 wherein said alkanolamine is selected from the group consisting of diethanolamine, triethanolamine, diisopropanolamine, and triisopropanolamine.

8. A demulsifying cleaning preparation in accordance with claim 1 including an aromatic sulfonate selected from the group consisting of cumene sulfonate and butylglycol sulfate as a solution promoter, phosphoric acid as a corrosion inhibitor for lightweight metals and tolyl triazole as a corrosion inhibitor for nonferrous metals.

9. A demulsifying cleaning preparation in accordance with claim 1 containing from about 3 to about 100% by weight of said demulsifying cleaning preparation, and from about 0 to about 97% by weight of water.

10. A demulsifying cleaning preparation free of organic solvent and having a prolonged surface-wetting effect consisting essentially of;

(a) a builder/complexing agent selected from the group consisting of ethylenediamine tetracetic acid, nitrilotriacetic acid, diethylenetriamine pentacetic acid, N-(2-hydroxyethyl)-ethylene diamine triacetic acid, and water soluble alkali metal salts thereof in an amount of from about 0.5 to about 10% by weight;

(b) at least one alkanolamine selected from the group consisting of diethanolamine, triethanolamine, diisopropanolamine, and triisopropanolamine in an amount of from about 20 to about 60% by weight;

(c) at least one nonionic surfactant selected from the group consisting of the condensation products of n-octanol with 4 moles of ethylene oxide, i-octanol with 4 moles of ethylene oxide, n-octanol with 2 moles of propylene oxide and 5 to 6 moles of ethylene oxide, and i-octanol with 2 moles of propylene oxide and 5 to 6 moles of ethylene oxide in a quantity of from about 1 to about 15% by weight; and (d) water in an amount which, with components (a), (b) and (c), adds up to 100% by weight, all weights being based on the weight of said cleaning preparation.

11. A demulsifying cleaning preparation in accordance with claim 10 including as optional constituents;

(e) a solution promoter in an amount of from about 1 to about 10% by weight, (f) a corrosion inhibitor for lightweight metals in an amount of from about 0.15 to about 0.25% by weight said corrosion inhibitor comprising phosphoric acid, (g) a corrosion inhibitor for nonferrous metals in an amount of from about 0.2 to about 0.4% by weight said corrosion inhibitor comprising tolyl triazole, and (h) a perfume or dye in an amount of from about 0 to about 1% by weight.

12. A demulsifying cleaning preparation in accordance with claim 10 including an aromatic sulfonate selected from the group consisting of cumene sulfonate and butylglycol sulfate as said solution promoter.

13. A demulsifying cleaning preparation in accordance with claim 10 containing from about 3 to about 100% by weight of said demulsifying cleaning preparation, and from about 0 to about 97% by weight of water.

* * * * *